US006118469A

United States Patent [19]

Hosomi

[11] Patent Number: 6,118,469

[45] Date of Patent: Sep. 12, 2000

[54] THERMAL PRINTER

[75] Inventor: Hiroaki Hosomi, Nagano-ken, Japan

[73] Assignee: Seiko Epson Corporation, Nagano-Ken, Japan

[21] Appl. No.: 08/919,950

[22] Filed: Aug. 29, 1997

Related U.S. Application Data

[63] Continuation-in-part of application No. 08/752,782, Nov. 20, 1996, Pat. No. 5,833,380, and a continuation-in-part of application No. 08/811,730, Mar. 6, 1997, Pat. No. 5,884,861, and a continuation-in-part of application No. 08/811,733, Mar. 6, 1997, Pat. No. 5,820,068.

[30] Foreign Application Priority Data

| | | | |
|---|---|---|---|
| Nov. 21, 1995 | [JP] | Japan | 7-303144 |
| Mar. 6, 1996 | [JP] | Japan | 8-049011 |
| Jun. 11, 1996 | [JP] | Japan | 8-149600 |

[51] Int. Cl.[7] ..... B41J 29/00; B41J 29/02

[52] U.S. Cl. ..... 347/222

[58] Field of Search ..... 347/200, 222; 400/691, 692, 693

[56] References Cited

U.S. PATENT DOCUMENTS

| | | | |
|---|---|---|---|
| 4,896,166 | 1/1990 | Barker et al. . | |
| 5,030,968 | 7/1991 | Benson et al. | 347/222 |
| 5,570,962 | 11/1996 | Suzuki et al. . | |
| 5,579,043 | 11/1996 | Patry | 347/222 |
| 5,820,068 | 10/1998 | Hosomi et al. | 242/563 |
| 5,833,380 | 11/1998 | Hosomi et al. | 400/621 |

*Primary Examiner*—Huan Tran
*Attorney, Agent, or Firm*—Loeb & Loeb, LLP

[57] ABSTRACT

A thermal printer for printing on a recording medium adapted to travel along a path through the thermal printer includes a frame and a thermal print head supported by the frame, the thermal print head carrying printing elements. A cover hinged to the frame is movable between an open position and a closed position. An elastomeric platen roller is rotatably supported by the cover, the thermal print head and the platen roller being relatively resiliently biased toward each other to urge the printing elements carried by the thermal print head into contact with a recording medium disposed between the thermal print head and the platen roller when the cover is in the closed position. The thermal print head includes a platen roller receiving surface positioned to intercept the elastomeric platen roller during movement of the cover to the closed position, the roller receiving surface having a contact area distributing the force exerted by the elastomeric platen roller against the thermal print head during the closing movement of the cover.

14 Claims, 11 Drawing Sheets

THERMAL PRINTER

CROSS REFERENCES TO RELATED APPLICATION

This application is a continuation-in-part of U.S. application Ser. Nos. 08/752,782 filed Nov. 20, 1996, U.S. Pat. No. 5,833,380; 08/811,730 filed Mar. 6, 1997, U.S. Pat. No. 5,884,861; and 08/811,733 filed Mar. 6, 1997, U.S. Pat. No. 5,820,068.

FIELD OF THE INVENTION

The present invention relates to thermal printers which are used with point-of-sales (POS) systems, cash registers, copy machines, facsimile machines and other office equipment.

BACKGROUND OF THE INVENTION

In a conventional thermal printer of the kind described, for example, in Japanese Laid Open Utility Model S63-148664 and U.S. Pat. No. 5,579,043, a roll of recording paper is installed by opening a cover, inserting the recording paper roll in the printer, and closing the cover. FIG. 10 herein is a cross section view of a portion of the thermal printer described in U.S. Pat. No. 5,579,043. When cover 213 is closed, a rubber paper drive roller 215 is set at a predetermined printing position. The paper drive roller 215 is rotatably supported by the cover 213 by means of a shaft 215*a*. A thermal print head 202 includes a rectangular radiation plate 206 and a ceramic substrate 203 attached to a front surface of the plate. The substrate 203 carries a row of heating points 204 which perform the printing functions. The thermal print head 202 is rotatably supported by a frame 201 through a shaft (not shown), and is pushed by a spring 209 toward the paper drive roller 215. By closing the cover 213, the paper drive roller 215 moves in the direction of an arrow Q, and recording paper 212 is pinched between the paper drive roller 215 and the thermal print head 202 at a predetermined position. During closing of the cover 213, the paper drive roller 215 first engages a tip 202*a* of the thermal print head 202, then moves while pushing the thermal print head 202 rearwardly, that is, toward the left, as seen in FIG. 10.

Conventional thermal printers such as that shown in FIG. 10 have some significant disadvantages. For example, the tip 202*a* presents to the surface of the rubber roller 215 a sharp, pointed configuration when the cover 213 is moved to the closed position. Accordingly, during closing of the cover 213, when the print drive roller 215 engages the tip 202*a* of the thermal print head, the tip 202*a* applies a concentrated impact force to the surface of the paper drive roller 215. This concentrated impact force may cause the thermo-sensitive layer of the recording paper 212 between the head 202 and the roller 215 to form colors which appear as print stains, or may damage the recording paper. This impact force may also cause deformation of the rubber paper drive roller 215. As a result, uneven print quality may occur and, in addition, the position of the substrate 203 (which carries the printing elements) may shift with respect to the radiation plate 206. Furthermore, in conventional thermal printers of the kind described, the cover may need to be pushed down a second time due to a reaction force generated when the paper drive roller 215 strikes the upper end face of the head substrate 203. As a result, the closing operation of the cover does not feel smooth to a user.

A thermal print head mechanism can be designed to permit the thermal print head to be retracted from the associated paper drive roller prior to inserting the recording paper so that the thermal print head does not contact the paper drive roller. After the recording paper is inserted in the printer, the thermal print head is returned to its position against the paper drive roller. However, such a mechanism requires the thermal print head to be first retracted from the paper drive roller and then moved back into contact with the paper drive roller. Such an operation complicates the process of replacing the recording paper.

The present invention solves the above-described problems of the prior systems. Accordingly, it is an object of the present invention to provide a thermal printer that not only eliminates stains, damage to the recording paper and deformation of the paper drive roller during closing of the printer cover but also provides smooth operation of the cover as it is moved to its closed position.

SUMMARY OF THE INVENTION

To achieve the above-described objects, a thermal printer in accordance with the present invention has a printer frame, a thermal print head having a heater section, an elastomeric platen roller operatively associated with the thermal print head to support and pinch a recording paper therebetween, the thermal print head and platen roller being relatively resiliently biased toward each other and a cover capable of opening and closing with respect to the printer frame. The thermal print head has a surface above the head substrate carrying the heater section, said surface being positioned to intercept and be engaged by the elastomeric platen roller as the cover is moved to its closed position, and is gradually sloped away from the platen toward an upper section thereof. The roller intercepting surface presents a contact large area to the roller so that the impact force imposed by the platen roller as the cover is moved to its closed position is distributed. The roller intercepting surface may be planar and preferably oriented at an angle of about 10 to about 60 degrees with respect to a printing side surface of the head substrate.

The roller intercepting surface projects from a printing side surface of the head substrate at a location immediately above the head substrate. As a result, the head substrate is protected from any impact force when the cover is closed and print stains and damage to the recording paper, and deformation of the platen roller are reduced. In addition, damage to the thermal print head from electrostatic charges is reduced.

Further, with the thermal print head configuration of the present invention, the amount of movement of the head substrate is increased due to the orientation of the roller intercepting surface which further reduces any impact force that may be applied to the head substrate.

The head substrate is mounted on a radiation plate, and the roller intercepting surface is formed on the radiation plate. With the above-described structure, the number of component parts is reduced and thus the manufacturing cost is reduced. Also, the platen roller is accurately positioned as it is brought into contact with the roller intercepting surface.

With the above-described structure, the force applied by the platen roller on the thermal print head is directed in the same direction in which the thermal print head is rotated. As a result, the thermal print head can be smoothly rotated, and thus the operability as well as the feel associated with the setting of recording paper are improved. Furthermore, the length of the roller intercepting surface may be made shorter. Accordingly, both the size and the cost of the thermal printer may be reduced.

BRIEF DESCRIPTION OF THE DRAWINGS

Further objects, features and advantages of the invention will become apparent from the detailed description below when read in conjunction with the accompanying drawings in which:

FIG. 5(*b*) is a side elevation view of a portion of the structure of FIG. 5(*a*), showing the relative positions of certain elements during movement of the cover to the closed position;

DETAILED DESCRIPTION OF THE PREFERRED EMBODIMENTS

Figure 1:
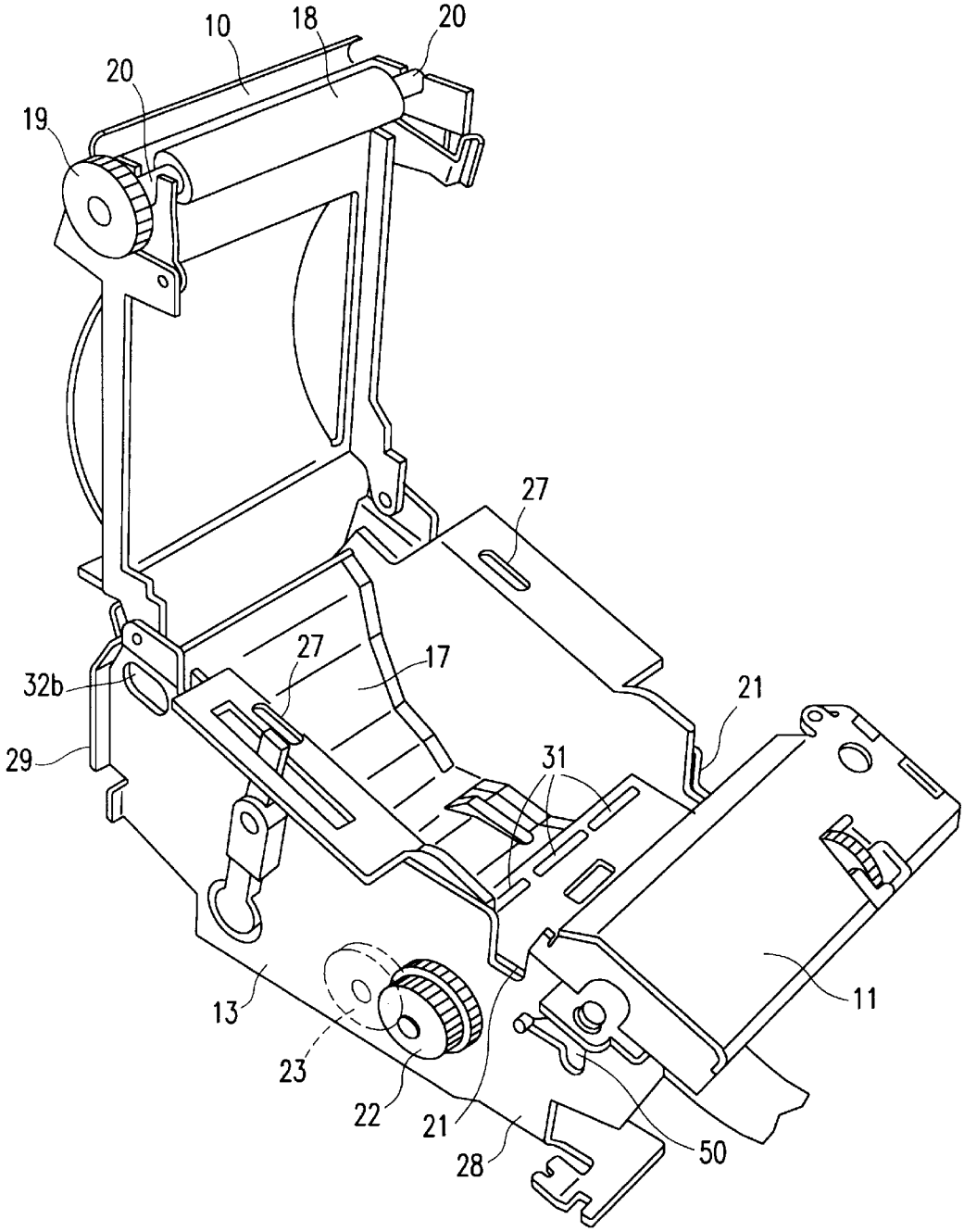
FIG. 1 is a perspective view of the internal structure of a thermal printer in accordance with a first, preferred embodiment of the present invention, the thermal printer being shown with its cover in the open position.

As used herein, the term "transverse" refers to a direction or orientation generally perpendicular to the direction of travel of the paper through the thermal printer. Also, the terms "upper", "lower", and the like, are used with reference to relative positions shown in the drawings to facilitate the description herein; it will be evident that the printer of the invention can be oriented in positions other than that shown in the drawings.

Figure 3:
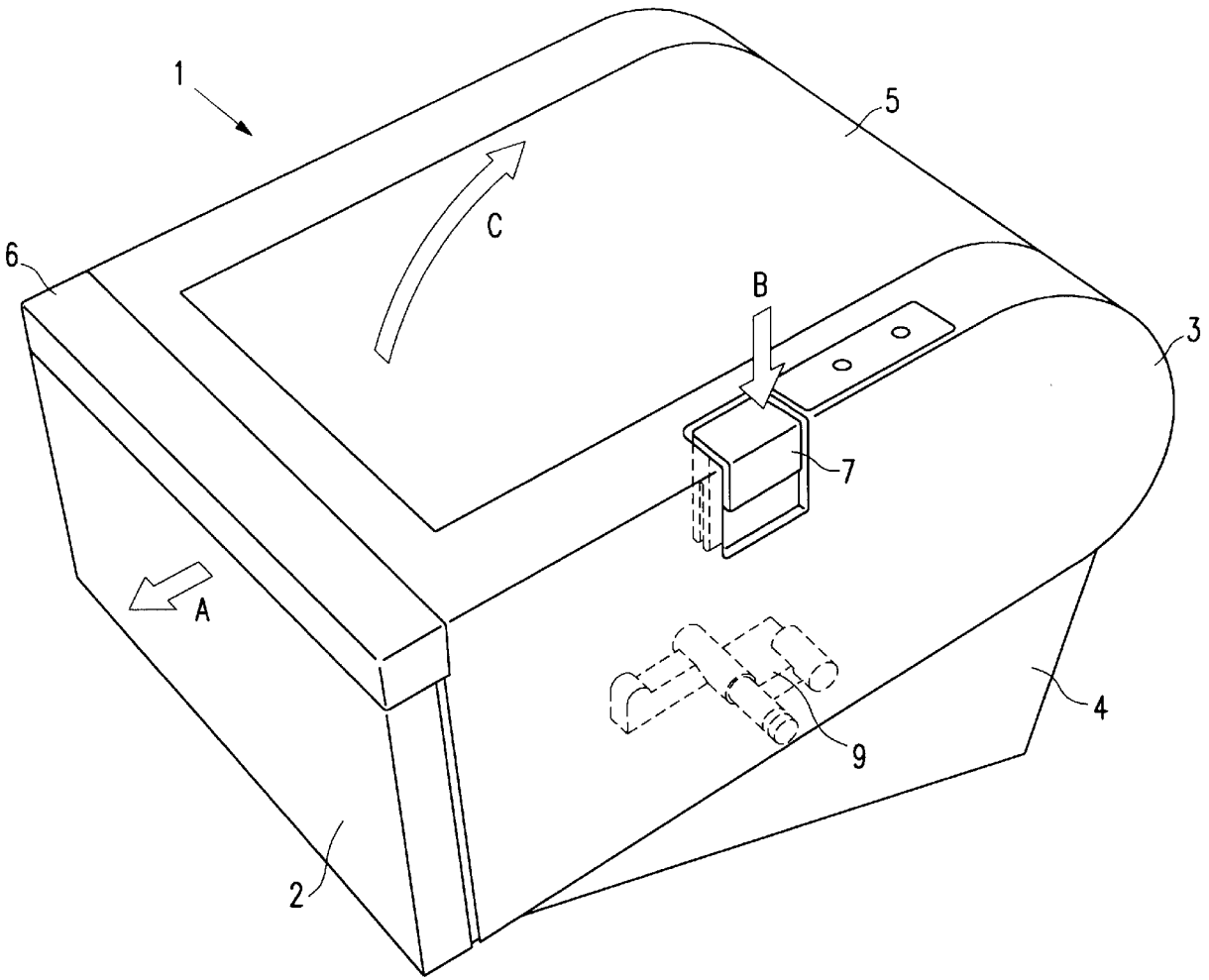
FIG. 3 is a perspective view of the exterior of the thermal printer of FIGS. 1 and 2.
Figure 4:
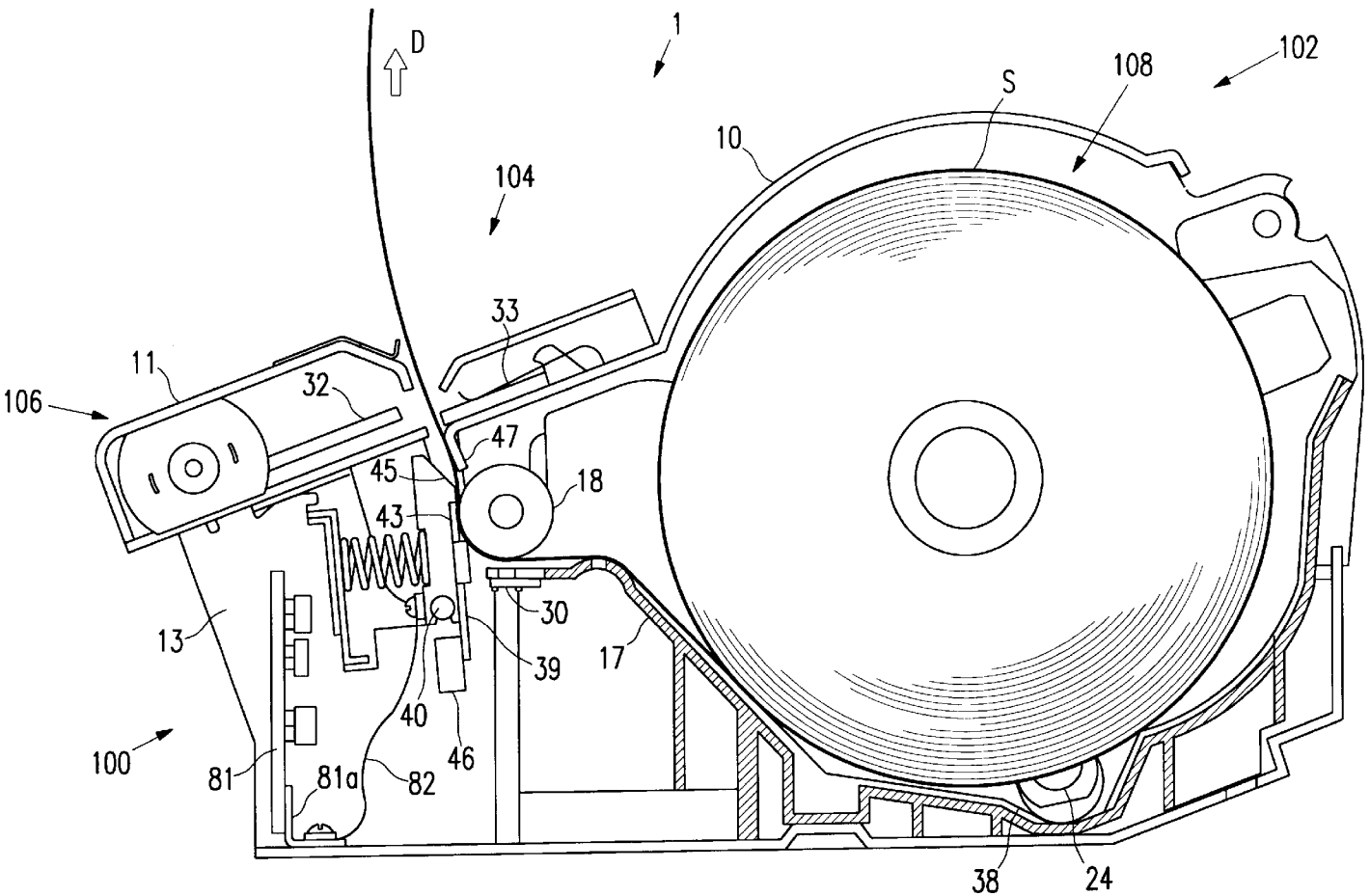
FIG. 4 is a side elevation view, in cross section, of the thermal printer of FIGS. 1 and 2.

With reference to FIGS. 3 and 4, the thermal printer 1 includes a thermal print head 39 that performs recording by printing on recording paper S drawn from a supply roll and driven along a path through the printer as indicated by the arrows. The thermal printer 1 has a front section 100 and a rear section 102. The front section 100 includes a recording section 104 and a paper cut section 106 and the rear section 102 has a rolled paper storage section 108. An internal printer mechanism 8 is fixed to a lower case 4 that may be made of plastic. The sides and rear of the printer mechanism 8 are covered by an upper case 3 and the front end of the printer mechanism 8 is covered by a panel 2. The paper cut section 106 is covered by a cover 6 which can be slid and pulled out in the direction of arrow A (FIG. 3).

A button 7 is placed on one side of upper case 3. When the recording paper S is to be removed, the button 7 is operated to drive a cover open lever 9 which rotates an internal cover 10. The cover 10 is connected to an upper cover 5. When the open button 7 is depressed in the direction of arrow B, the upper cover 5 rotates in the direction of arrow C exposing the rolled paper storage section 108.

Figure 2:
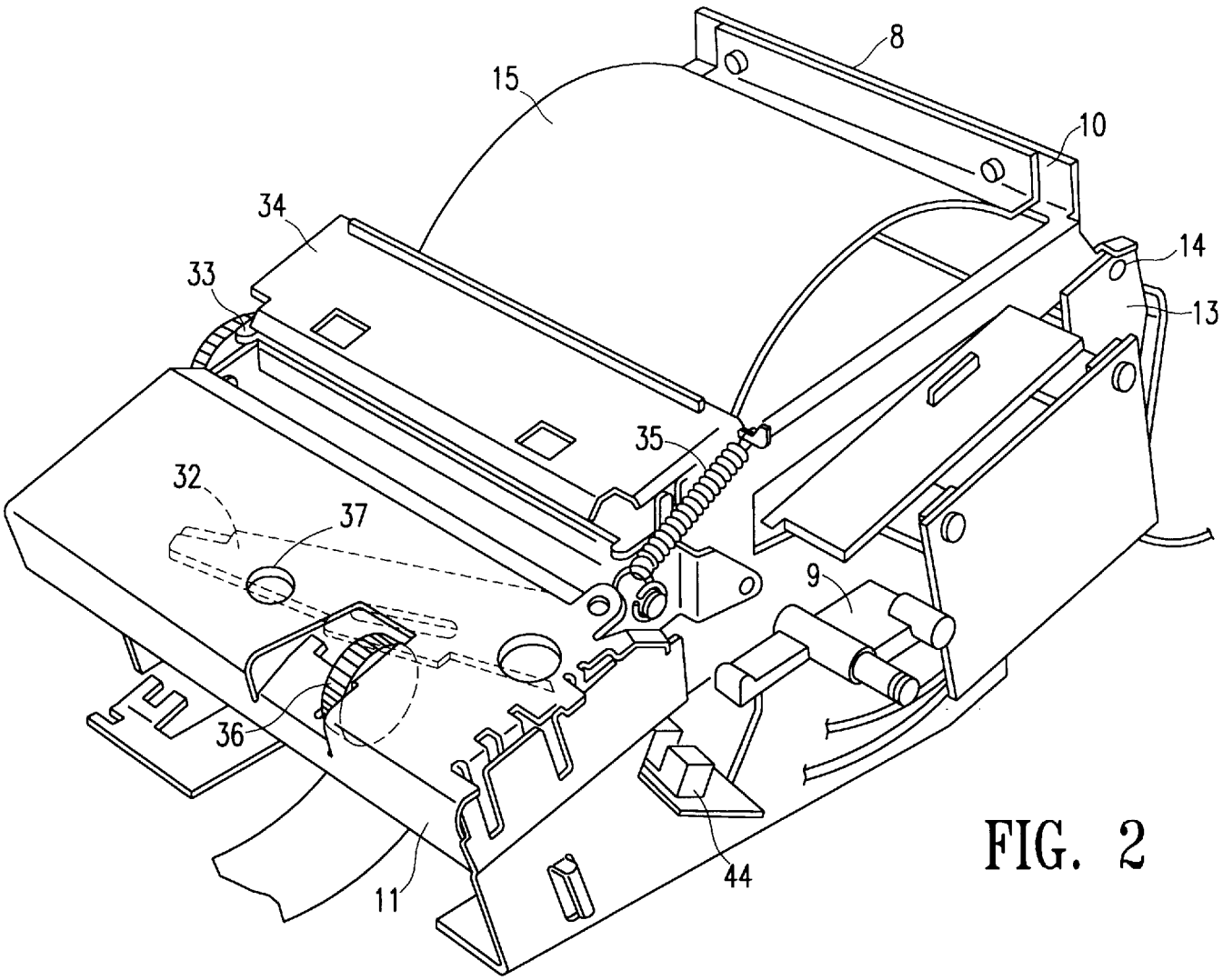
FIG. 2 is a perspective view of the structure of the thermal printer of FIG. 1 with the cover in the closed position.

FIGS. 1 and 2 show perspective views of the internal printer mechanism 8 of printer 1. FIG. 2 shows a right-side perspective view of the printer mechanism 8 when the cover 10 is closed. The cover 10 and an automatic cutter unit 11 that stores a movable blade 32 and a driving device for driving the movable blade 32 are mounted on a main frame 13 that is made of a metal or a similar material. When the recording paper S is not cut, for example, during printing, the movable blade 32 is stored inside the automatic cutter unit 11. The movable blade 32 is therefore placed in a standby position.

A fixed blade 33, which crosses the movable blade 32 like a pair of scissors, is mounted on the cover 10 opposite the automatic cutter unit 11. A blade shutter 34 is provided over the fixed blade 33. A spring force is applied to the blade shutter 34 by a spring 35 in the direction in which the blade shutter 34 covers the blade section of the fixed blade 33. When the cover 10 is closed as shown in FIG. 2, a part of the blade shutter 34 abuts an engaging section provided on the main frame 13 so that the blade shutter 34 is lifted up in a direction in which the blade shutter 34 opens. As a result, the blade section of the fixed blade 33 is exposed so that the movable blade 32 can be moved to cross the fixed blade 33 like a pair of scissors.

A hole 37 is defined in an upper surface of the automatic cutter unit 11 for allowing a user to confirm the position of the movable blade 32, and a knob 36 is provided on the upper surface of the automatic cutter unit 11 for allowing a user to manually move the movable blade 32. When a user slides the cutter cover 6, a part of the upper surface of the automatic cutter unit 11 is exposed so that the user can view the hole 37 and the knob 36. In an emergency, such as power failure, the movable blade 32 may stop while the movable blade 32 crosses the fixed blade 33 and may not return to the standby position. In such a case, the movable blade 32 can be manually moved.

The cover 10 can be moved or opened and closed about shafts 14 that are provided at the upper side sections of the main frame 13. The cover 10 has an arc-like curved section 15 for preventing the recording paper S from contacting the cover 10 when the cover 10 is closed. The curved section 15 also functions as a supporting member for supporting the recording paper S when the printer is placed in a different orientation.

A cover detector 44 is provided on the right side of the main frame 13 for detecting whether the cover 10 is closed. The cover detector 44 is a transmission type optical detector that detects if a part of the cover 10 shuts the optical path of the detector 44. By this operation, the system can detect whether the cover 10 is correctly closed.

FIG. 1 shows a left-side perspective view of the printer mechanism 8 in which the cover 10 is opened. When the cover 10 is opened, the blade shutter 34 covers the fixed blade 33 and the movable blade 32 is stored in the automatic cutter unit 11.

A rolled paper holder 17 that is made of plastic is placed inside the cover 10. The paper detector 30 is placed in the rolled paper holder 17 immediately before the printing section in order to detect the presence of the recording paper. The paper detector 30 can be a reflective type optical detector. Openings 31 are defined in the rolled paper holder 17 in the upstream of the paper detector 30. Foreign matters and paper powder adhered to the recording paper are scraped off and dropped through the openings 31 so that malfunction of the detector 30 due to paper powder and the like will not occur. The rolled paper holder 17 also includes slits 27 that engage both of the side plates of the main frame 13 to maintain an appropriate width of the interior of the recording paper storage section.

A platen roller 18 can be formed from a cylindrical elastomeric, for example, rubber, roller and rotatably supported on the cover 10 through platen roller shaft supports 20. A platen gear 19 is inserted in one end of the platen roller shaft 18*a*. The main frame 13 has groove sections 21. When the cover 10 is closed, the platen roller shaft supports 20 abut the groove sections 21 so that the platen roller 18 is appropriately set at a predetermined position. When the cover 10 is closed, the thermal print head pushes the platen roller 18 with a predetermined pressure force which generates a downwardly directed force in the cover 10 which in turn fixes the position of the platen roller 18. Also, when the cover 10 is closed, the platen gear 19 engages a paper feed transfer gear 22 so that a driving force is transferred from a paper feed motor 23 to the platen roller 18.

Support groove sections 50 are provided in the right and left sides of the main frame 13 for supporting a thermal print head 39 and a head pressure plate 41 which will be described below. On the thermal head 39, at least one row of heating elements 43 are arranged in the width direction of the recording paper S.

FIG. 4 shows a side view of the printer mechanism 8 in which a roll of recording paper S is retained in the rolled paper holder 17 and the paper is fed through the printer.

The recording paper S is pinched between the platen roller 18 and the thermal print head 39, and is fed by the friction of the platen roller 18 as the platen roller 18 is rotated. Head support shafts 40 are provided on both sides of the thermal print head 39. The head support shafts 40 are supported by portions of the support groove sections 50 that are on the main frame 13. A spring 42 pushes a rear surface of the thermal print head 39 toward the platen roller 18. The spring 42 is fixed to a head pressure plate 41. The head pressure plate 41 is supported by a portion of the support grooves 50 on the main frame 13.

A heater 43 of the thermal print head 39 is located at or adjacent to the area where the platen roller 18 and the thermal print head 39 contact each other. In accordance with the present embodiment, the length L1 of the contact area (in the paper transfer direction) may be, for example, about 1.5 to about 3 millimeters. The length of the contact area is determined based on several factors including the length of the heater, rows of the heating elements, printing quality and a friction coefficient at a time when the platen contacts the thermal head without the recording paper therebetween. In the case where the length is short, it is necessary to enhance the positioning accuracy of the platen with respect to the heating elements. In the case where the length is large, the friction load to the platen may become greater when the recording paper is not inserted therebetween so that it becomes necessary to use a high power motor or a high power current source.

A metallic axle having a diameter of, for example, about 4 millimeters, is inserted in the rubber having a thickness of, for example, about 4 millimeters to form the platen roller 18. Then, the diameter of the platen roller becomes, for example, about 12 millimeters. The hardness of the rubber of the platen roller 18 is 42±5 which is designated by a hardness measure: type A regulated by JIS K6301. The thermal head is pressed against the platen roller by an elastic member, such as a coil spring by a force of about 24.5 Newton so that the rubber is elastically deformed to create the contacting area having the length of, for example, about 1.5 mm to about 3 mm in the direction of paper travel. This length L1 is shown on FIG. 6. A roller intercepting surface 45 is provided on the thermal print head 39 on the downstream side of the heater 43 in relation to the direction of travel of the recording paper. A guide section 47 is provided in the cover 10 at a location opposing the surface 45 of the thermal print head 39. The guide section 47 guides the recording paper S into the paper cutter section. After the recording paper S passes the thermal print head 39, the recording paper S then passes through a gap between the movable blade 32 and the fixed blade 33 and discharged in the direction of an arrow D. The thermal print head 39 is equipped with a connector 46 that is connected by an FFC or the like to a main circuit board 81 for controlling the printer in accordance with the present embodiment.

An overall and basic structure of the printer in accordance with the present embodiment has been described above. Next, characteristic features of a thermal printer in accordance with the present invention will be described in detail with reference to FIGS. 5 through 8.

Figure 8:
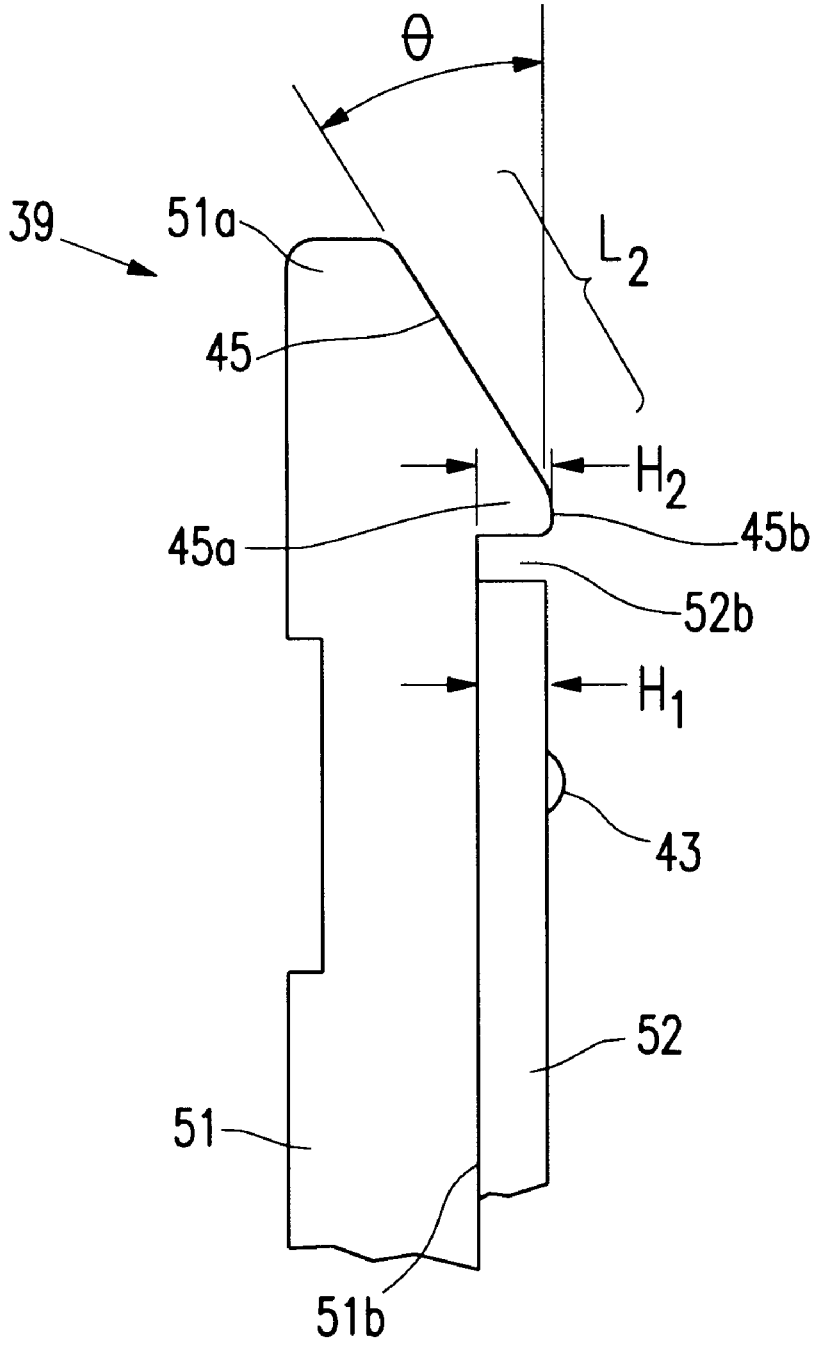
FIG. 8 is a side elevation view of a portion of the thermal print head of the invention, showing certain geometric features thereof.
Figure 9:
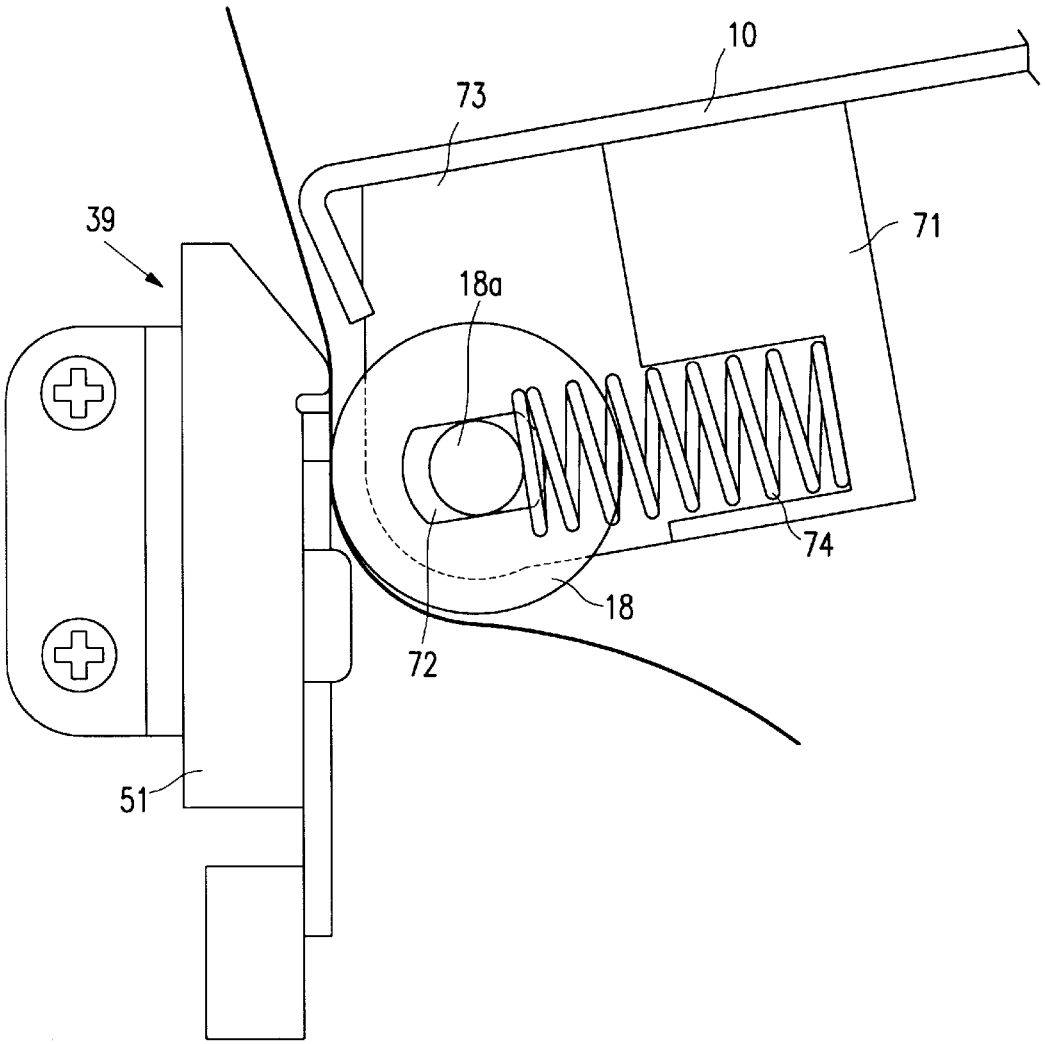
FIG. 9 is a side elevation view of portions of a thermal print head in accordance with a second embodiment of the present invention.
Figure 10:
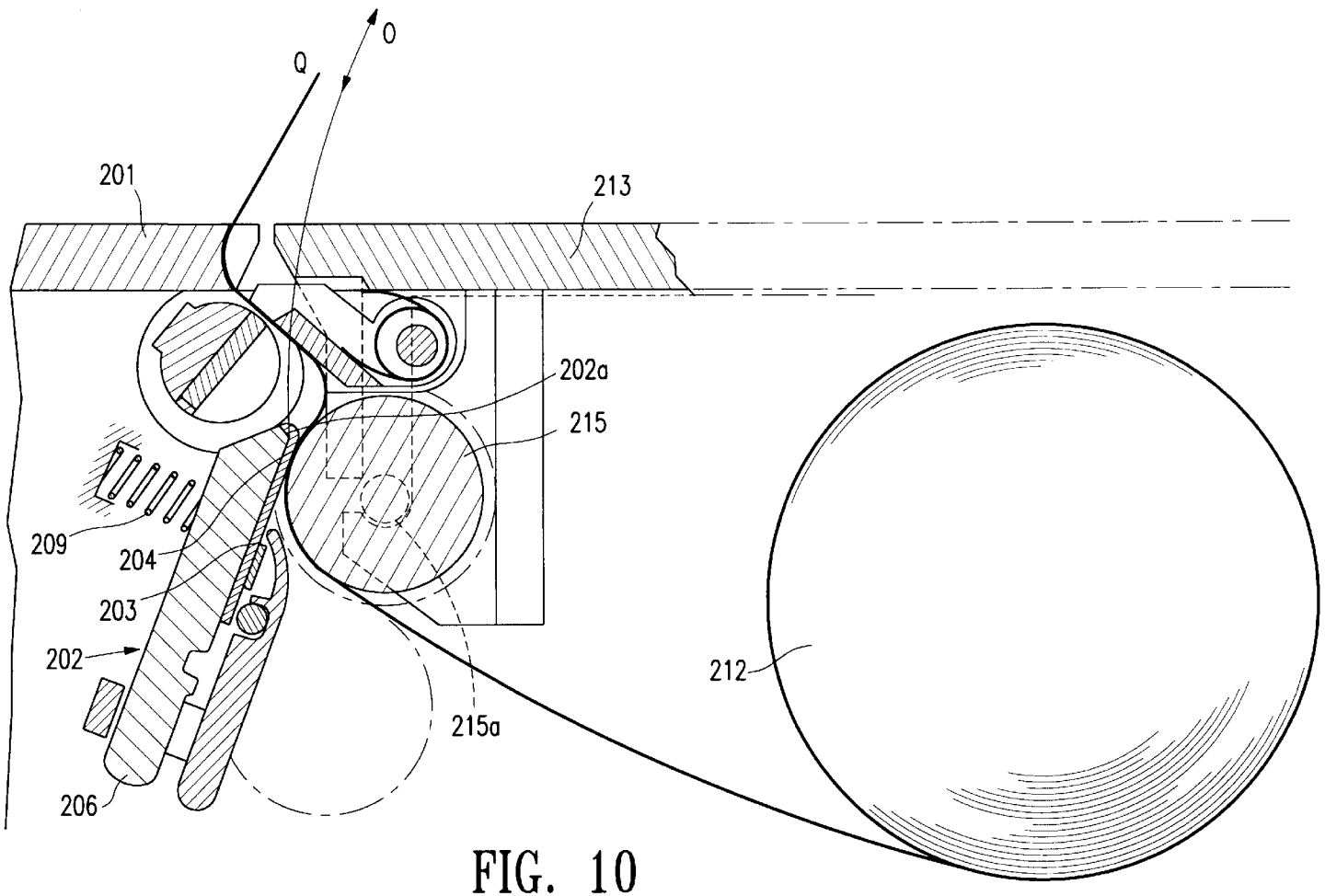
FIG. 10 PRIOR ART
FIG. 10 is a side elevation view, partly in cross section, of the main portion of a prior art thermal printer as disclosed in U.S. Pat. No. 5,579,043.

FIG. 8 shows thermal head 39 of the thermal printer in accordance with one preferred embodiment of the present invention. The thermal head 39 comprises a radiation plate 51 and a head chip or substrate 52. The radiation plate 51 is preferably formed from aluminum by a drawing, extrusion or die-cast process. The radiation plate 51 has an upper portion 51*a* including the surface 45. The radiation plate 51 and the upper portion 51*a* thereof are preferably integrally formed in one piece to reduce the number of parts and the manufacturing cost. In accordance with one specific form of the invention the surface 45 may be a substantially planar or flat area having a length L2 in the direction of paper travel (FIGS. 5(*b*) and 8).

The substrate 52, which may have a thickness of about 1 mm, includes pattern electrodes and heater elements 49 (FIG. 6) formed thereon and is attached to a surface 51*b* of the radiation plate 51 by an adhesive, a two-side adhesive tape or similar bonding agent. The surface 51*b* serves as a reference surface for the substrate 52. After attaching the substrate 52 to the surface 51*b*, the height of the substrate relative to the reference surface 51*b* is H1, which may, for example, be about 1.1 mm to about 1.2 mm. The upper portion 51*a* of the plate 51 further includes a projection 45*a* having an outer, convex transition surface 45*b* having a height H2 with respect to the reference surface 51*b*. The H2 is preferably approximately equal to H1, although alternatively, H2 may be made somewhat greater than H1. With the above structure, it is possible to prevent the upper edge 52*d* (FIG. 5(*b*)) of the substrate 52 from damaging the platen roller 18 when the platen roller passes the edge 52*d* during closing of the cover 10.

Figure 5A:
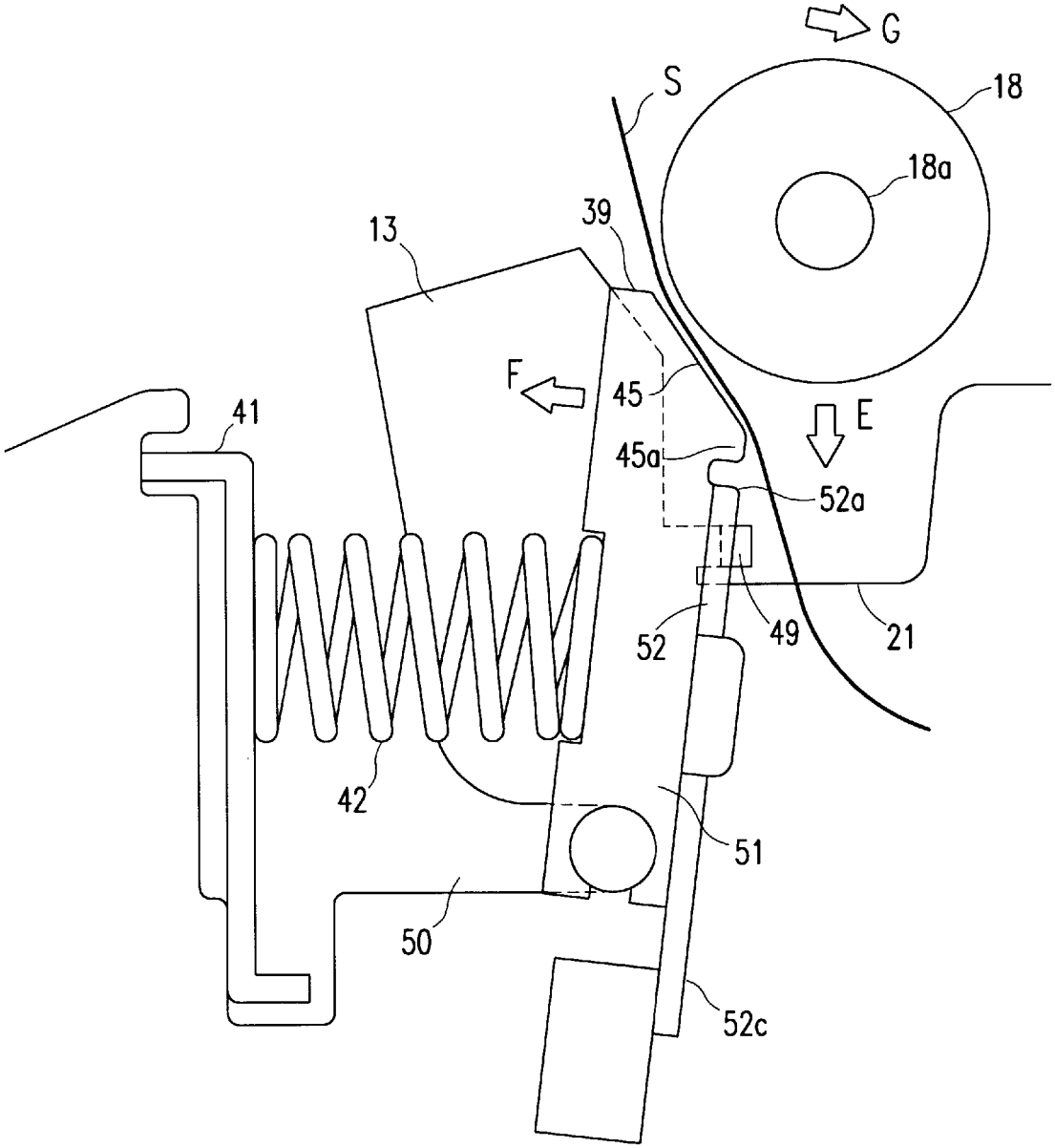
FIG. 5(*a*) is a side elevation view of a portion of the structure shown in FIG. 4, showing elements of the thermal print head and platen roller in accordance with the first embodiment of the invention, with the cover of the thermal printer in its open position.
Figure 5B:
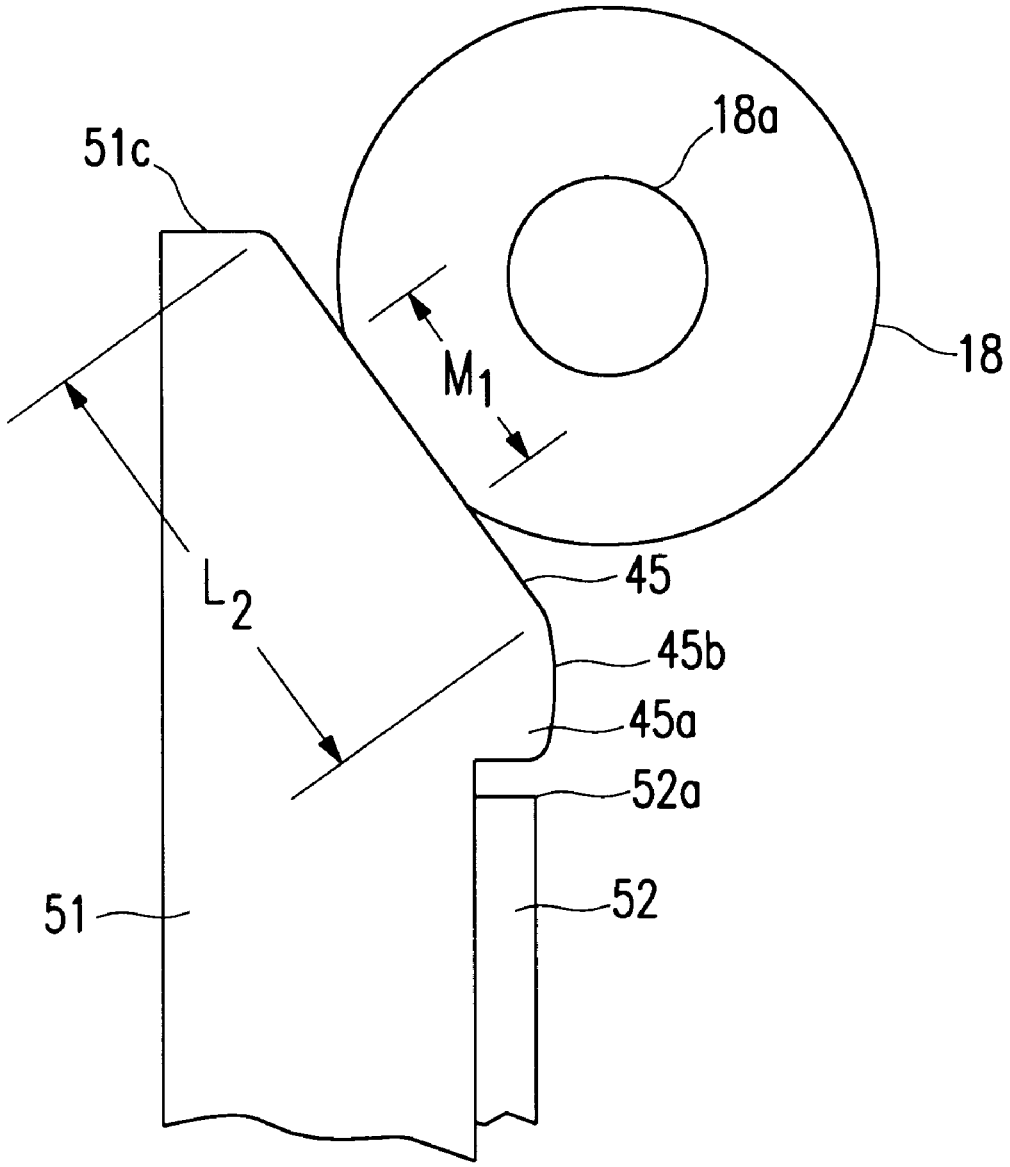

FIGS. 5(*a*) and 5(*b*) show cross-sectional views of the recording section. In FIG. 5(*a*) the cover 10 is in the open position and in FIG. 5(*b*), the cover 10 is shown just after the start of the closing movement. The support shafts 40 of the thermal print head 39 engage the support groove sections 50 in the main frame 13 so that the thermal print head 39 is rotatable and set at a predetermined position. The head pressure plate 41 is mounted on the main frame 13. The thermal print head 39 is pushed by the spring 42 that is mounted on the head pressure plate 41. The thermal print head 39 includes a radiation plate 51 having outer retaining sections 51*b* (see FIG. 7). The retaining sections 51*b* of radiation plate 51 abut head positioning sections 49 provided in the main frame 13 in order to set the thermal print head 39 at a predetermined position. The rotational movement of the thermal head 39 is stopped by the head positioning sections 49 when the cover frame 10 is in the opening position at a position of which distance from the rotational center is nearly equal to that of the row of the heater elements.

After the recording paper S is mounted, and the cover 10 is moved toward the closed position, the platen roller 18 moves in the direction of arrow E (FIG. 5(*a*)). The platen roller 18 is then intercepted by the surface 45. The surface 45 may have an area of sufficient length to cover a contacting area of the platen roller 18; thus, the length L2 of the surface 45 is greater than the length M1 of the roller contacting area (FIG. 5(*b*)). Therefore, when the platen roller 18 engages the surface 45, the entire length of the contacting area of the platen roller 18 is received by the surface 45. As a result, an impact force that may be generated as a result of contact between the platen roller 18 and the surface 45 is distributed and its effect concomitantly reduced. Furthermore, color generation in the recording paper, damage to the recording paper and permanent deformation of the platen roller 18 are substantially reduced. In this embodiment, as aforementioned, a rubber having a comparatively low hardness is selected for the material of the platen roller 18 in order to obtain good print quality so that the platen rubber can be easily damaged by the upper edge 52*d* of the substrate 52.

Since the position of the thermal head 39 when the cover is in the opening position is determined by the head positioning sections 49, and the position of the head positioning sections 49 are far from the pivot of the radiation plate 51 defined by the support shafts 40, that is, near the upper portion 51a of the radiation plate 51, the platen roller 18 can accurately land on the center of the surface 45 (in the paper travel direction) when the cover frame 10 is closed, thereby it is possible to prevent the platen from being brought into contact with the upper extremity 51*c* of the radiation plate 51.

Also, since the impact force is reduced, the cover 10 can be smoothly closed, and therefore operability and user "feel" is improved. As indicated, the surface 45 may be planar. However, in an alternative embodiment, the surface section 45 may have a concave shape that has a larger radius of curvature than that of the platen roller 18 to obtain a similar effect.

With reference to FIG. 5(*a*), when the cover 10 is further closed, the platen roller 18 is intercepted by and engages the surface 45. The surface 45 is so sloped that the downwardly moving platen roller 18 rotates the thermal print head 39 in the direction of arrow F. Because the platen roller 18 is rotatably supported by the platen roller shaft supports 20, the platen roller 18 rotates in the direction of arrow G and moves in the direction of arrow E. When the platen roller shaft supports 20 abut the groove surfaces 21 provided in the main frame 13, the platen roller 18 is set at a predetermined position. Since the groove surfaces 21 and the head positioning tabs 49 are both formed in the main frame 13, the thermal print head 39 is correctly set at a predetermined position when the cover 10 is in its closed position. Because of the high positioning accuracy, the surface 45 may be made shorter in the paper travel direction. As a consequence, the size of the thermal print head is reduced, the size of the printer is reduced and thus the manufacturing cost is reduced.

Figure 6:
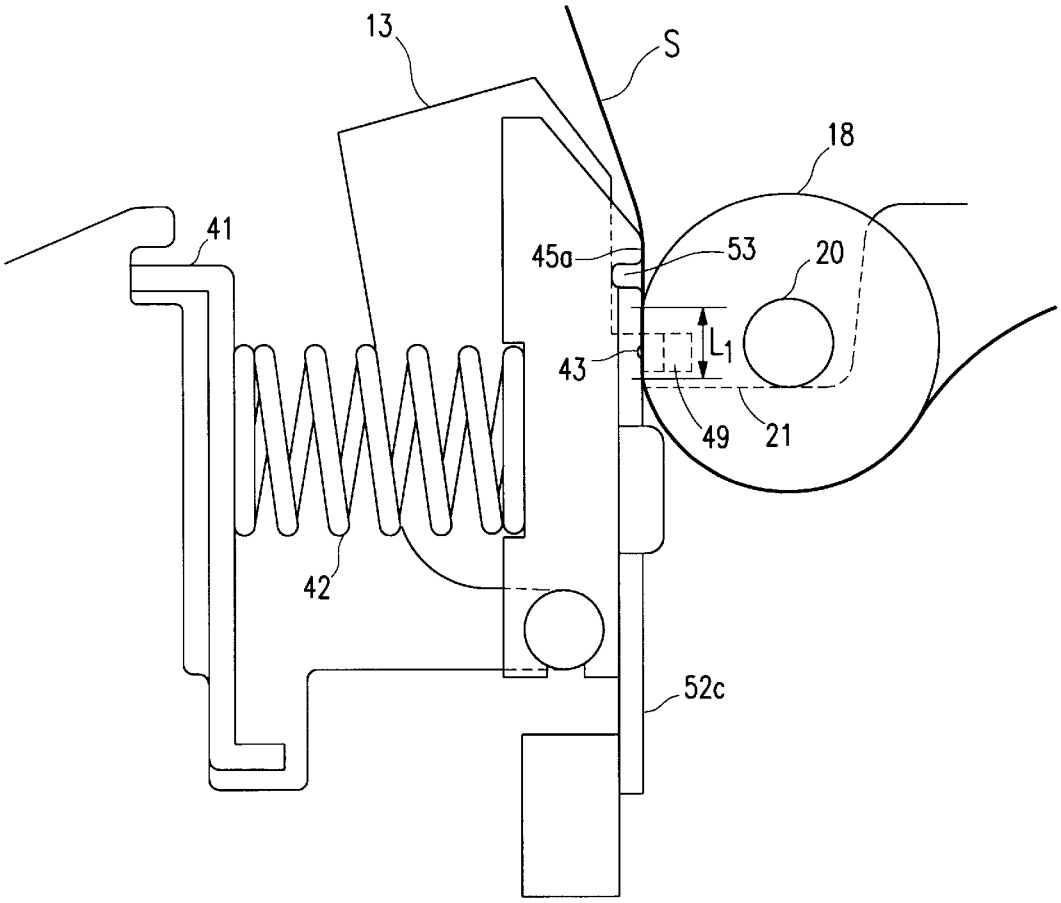
FIG. 6 is a side elevation view along the lines of FIG. 5(*a*) showing the relative positions of the elements when the cover is in its closed position.

FIG. 6 shows a cross-sectional view of the print mechanism when the cover 10 is closed and the platen roller 18 is set at a printing position. As the platen roller 18 is moved to the printing position, the thermal print head 39 rotates against the spring force of the spring 42, and the abutment surfaces 51*b* are moved away from the head positioning sections 49. The thermal print head 39 is urged or biased against the platen roller 18 by the force of the spring 42 and is set at the printing position in which the thermal print head 39 is ready for printing. In this position, the platen roller 18 is pressed by virtue of the spring 42 and is deformed by the surface of the substrate 52 to form a flat contacting area having a length L1 in the paper travel direction, where L2>L1. For a length L1 ranging from about 1.5 mm to about 3 mm, the length L2 may be, for example, about 5 mm to about 6 mm, but may be greater or less depending on the values of a number of parameters, including L1, the thickness of the radiation plate 51, the angle θ, etc., as will be evident to those skilled in the art.

In the operation of mounting the roll of recording paper in accordance with the present embodiment, the thermal print head 39 is not required to be retracted in the direction of the arrow F before the operation of closing the cover 10 is started. As a result, the operation of setting the roll of recording paper becomes easier.

Figure 7:
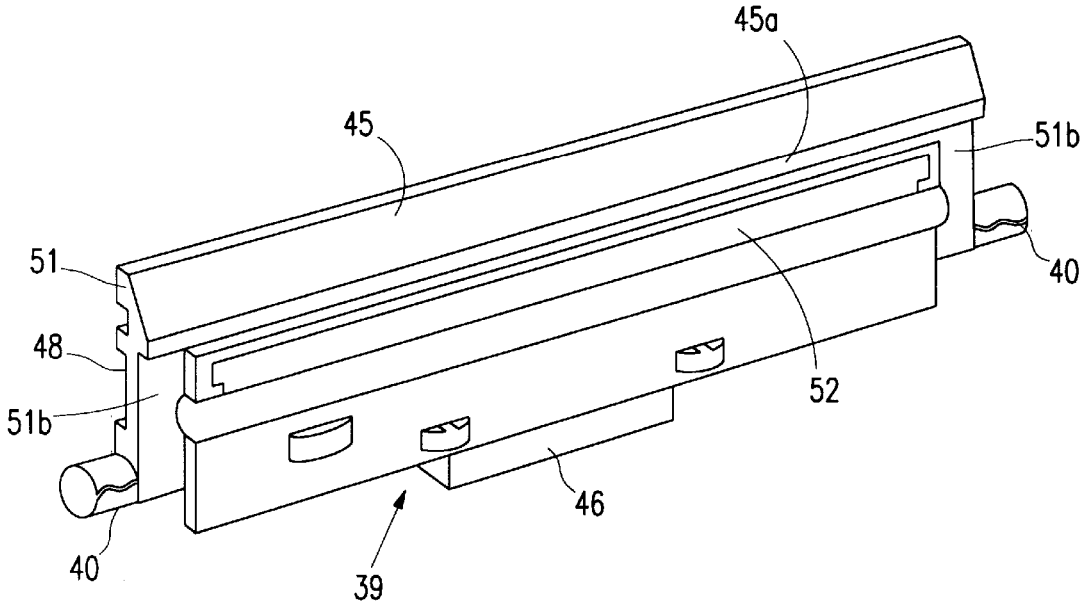
FIG. 7 is a perspective view of a thermal print head in accordance with the first embodiment of the invention.

As seen in FIG. 7, the transverse length of the head substrate 52 is shorter than the transverse length of the radiation plate 51, and therefore the retaining sections 51*b*, which are parts of the radiation plate 51 on the right and left sides thereof, extend beyond the head substrate 52. Therefore, when the cover 10 is opened, the retaining sections 51*b* of the thermal print head 39 abut the head positioning sections 49, but the head substrate 52 does not contact the head positioning sections 49. This structure prevents conductive traces formed on the head substrate 52 from being damaged by the initial impact force.

It will be seen in FIG. 8 that in accordance with one form of the invention, the convex transition surface 45*b* on the projection 45*a* blends smoothly into the surface 45. The convex surface 45*b* prevents the platen roller 18 from hitting a top edge 52*a* (see FIG. 5(*a*)) of the substrate 52 while the platen roller 18 is moving in the direction of arrow E, and alleviates an impact force if the platen roller 18 does not strike the upper extremity of the head substrate 52.

Electrode patterns and the heating elements 43 are formed on the thermal print head substrate 52 by sputtering or screen printing. Therefore, if an electrified object is brought closer to the surface of the substrate 52, the heating elements 43 formed on the substrate or the driving circuit might be damaged by electrostatic discharge. In accordance with the present embodiment, the radiation plate 51 is grounded to the main frame 13 because the frame 13 is made of a metallic material such as steel, and therefore electrostatic energy is not discharged onto the surface of the substrate. Instead, electrostatic energy is discharged onto the convex section 45*a*. Accordingly, the convex section 45*a* is also effective in preventing destruction of the thermal print head by electrostatic energy. Furthermore, if the platen roller 18 is electrostatically charged the charge may destroy the heating elements when the cover 10 is closed. However, in accordance with the present invention, since the roller 18 first engages the surface 45, any electrostatic charge on the platen roller 18 is discharged to the surface 45 thus avoiding damage to or destruction of the heating elements or related circuitry. In this connection, a circuit board 81 provided with a controlling circuit of the printer is fixed to the main frame 13 or bottom case 4 with a bracket 81*a*. The radiation plate 51 is electrically connected to a ground trace on the circuit board 81 with a wire 82. The wire 82 can be replaced by the frame 13 and the related parts when the frame is made of an electrically conductive material and all of the parts interposed between the radiation plate 51 and the frame 13 are made of electrically conductive material. In general, the ground trace on the circuit board 81 is connected to an external earth ground terminal. With this structure, the static electricity accumulated on the recording paper or the platen roller 18 can be discharged via the radiation plate 51 and the wire 82.

Further in accordance with the present invention, a small gap 53 (FIG. 6) is provided between the lower extremity of the projection 45*a* and the top end 52*a* of the substrate 52. When the substrate 52 is bonded to the radiation plate 51, the distance between the position of the heating elements 43 and the head supporting shaft 40 is precisely measured by an optical measuring device. In order to provide a high print quality, the position of the platen roller 18 with respect to the heating elements must be precisely set. By providing the gap 53, variations in the size and shape of the head substrate 52 and the radiation plate 51, if any, can be accommodated within the range of the gap when the substrate 52 is fixed to the radiation plate 51. Without such a gap, such variations cannot be compensated for. As a result, the heating elements 43 would likely be incorrectly positioned, resulting in poor print quality.

In accordance with the present embodiment, the spring 42 has a spring force of 24.5 Newton and the shift amount of the thermal print head 39 that is pushed by the platen roller 18 is approximately two (2) millimeters. In this case, the surface 45 is preferably oriented at an angle θ of about 10 degrees to about 60 degrees with respect to the reference surface 51*b*. If the angle θ is less than 10 degrees, the surface 45 has to be made longer to provide the same shift distance of the thermal print head 39 in the direction of F(FIG. 5(*a*)), requiring a larger thermal print head and thus increased manufacturing cost. On the other hand, if the angle θ is more than 60 degrees, a force component acting from the platen roller 18 to the thermal print head 39 in the direction of the arrow F (that is generated when the platen roller 18 engages the surface 45 as the cover 10 is closed) becomes smaller. As a result, the force to rotate the thermal print head 39 also becomes smaller, and thus a greater force is required to lower the cover 10, which adversely affects the printer's operability. Also, print stains are more likely to be generated by an increased pressure of the convex surface 45*b* against the paper.

Several specific embodiments of the invention have been described. It will be evident, however, that changes and modifications may be made, or equivalents substituted for the various elements, without departing from the invention whose scope is defined by the accompanying claims.

What is claimed is:

1. A thermal printer for printing on a recording medium adapted to be driven along a path through the printer, the thermal printer comprising:

a frame;

a thermal print head movably supported by the frame, the thermal print head having a printing side surface and an upper end, and carrying a substrate including printing elements adapted to contact the recording medium;

a cover hinged to the frame, the cover being movable between an open position and a closed position relative to the frame;

an elastomeric platen roller rotatably supported by the cover, the path of the recording medium passing between the substrate and the platen roller; and a spring urging the thermal print head and the elastomeric platen roller relatively toward each other, the thermal print head being thereby adapted to press the printing elements against the recording medium, the thermal print head further defining a surface disposed above the substrate and positioned to intercept the elastomeric platen roller as the cover is moved to its closed position and having an area at least as large as the contact area of the elastomeric platen roller when the roller engages said intercepting surface as the cover is moved to its closed position.

2. A thermal printer, as defined in claim 1, wherein;

the roller intercepting surface slopes away from the printing side of the thermal print head toward the upper end of the thermal print head.

3. A thermal printer, as defined in claim 1, wherein the thermal print head includes a radiation plate, the radiation plate defining the roller intercepting surface and the printing side surface, the substrate being mounted on the printing side surface of the radiation plate.

4. A thermal printer, as defined in claim 3, wherein:

the roller intercepting surface slopes away from the printing side surface of the thermal print head toward the upper end of the thermal print head, and wherein the roller intercepting surface is oriented at an angle of between about 10 degrees and about 60 degrees with respect to the printing side surface of the radiation plate.

5. A thermal printer for printing on a recording medium adapted to travel along a path through the thermal printer, the thermal printer comprising:

a frame;

a thermal print head supported by the frame, the thermal print head comprising:

a radiation plate having a reference surface; and a substrate attached to the reference surface of the radiation plate, the substrate having a printing side surface carrying printing elements;

a cover supported by the frame, the cover being movable between an open position and a closed position relative to the frame;

an elastomeric platen roller rotatably supported by the cover, the path of travel of the recording medium passing between the platen roller and the printing side surface of the substrate, the elastomeric platen roller having an outer surface;

resilient means for urging the thermal print head and the elastomeric platen roller relatively toward each other to form a contact area between the outer surface of the elastomeric platen roller and the printing side surface of the substrate when the cover is in the closed position, said contact area having a first length in the direction of travel of the recording medium; and wherein:

the radiation plate has a platen roller receiving surface for intercepting the elastomeric platen roller as the cover is moved to the closed position, the platen roller receiving surface comprising an area having a second length in the direction of travel of the recording medium, the second length being greater than the first length.

6. A thermal printer, as defined in claim 5, in which:

a second contact area is formed between the outer surface of the elastomeric platen roller and the platen roller receiving surface when the platen roller engages the platen roller receiving surface during movement of the cover to the closed position, the second contact area having a third length in the direction of travel of the recording medium, the third length being less than the second length.

7. A thermal printer, as defined in claim 5, in which:

the platen roller receiving surface on the radiation plate is sloped with respect to the reference surface so as to guide the platen roller as the cover is moved to its closed position.

8. A thermal printer, as defined in claim 5, in which:

the roller receiving surface is sloped to gradually move the thermal print head away from the platen roller in opposition to the urging of the resilient means during movement of the cover to the closed position.

9. A thermal printer, as defined in claim 5, in which:

the thermal print head has a rear printing side, a front side and an upper extremity; and the roller receiving surface is a substantially planar surface sloping from the rear side of the thermal print head toward the front side and the upper extremity thereof.

10. A thermal printer, as defined in claim 9, in which:

the roller receiving surface is oriented at an angle of between about 10 degrees and about 60 degrees relative to the rear side of the thermal print head.

11. A thermal printer, as defined in claim 9, in which:

the thermal print head further defines a convex transition surface adjacent the rear side, the roller receiving surface blending into the convex transition surface.

12. A thermal printer for printing on a recording medium adapted to travel along a path through the thermal printer, the thermal printer comprising:

a frame;

a thermal print head supported by the frame, the thermal print head carrying a row of printing elements;

a cover hinged to the frame, the cover being movable between an open position and a closed position;

an elastomeric platen roller rotatably supported by the cover, the thermal print head and the platen roller being relatively resiliently biased toward each other to urge the printing elements carried by the thermal print head into contact with a recording medium disposed between the thermal print head and the platen roller when the cover is in the closed position; and the thermal print head including a platen roller receiving surface positioned to intercept the elastomeric platen roller during movement of the cover to the closed position, the roller receiving surface having a contact area distributing the force exerted by the elastomeric platen roller against the thermal print head during the closing movement of the cover, and in which the thermal print head has a rear printing side, a front side and an upper extremity:

the roller receiving surface is a substantially planar surface sloping from the rear side of the thermal print head toward the front side and the upper extremity thereof; and the thermal print head further defines a convex transition surface adjacent the rear side, the roller receiving surface blending into the convex transition surface.

13. A thermal printer for printing on a recording medium adapted to travel along a path through the thermal printer, the thermal printer comprising:

a frame;

a thermal print head supported by the frame, the thermal print head carrying a row of printing elements;

a cover hinged to the frame, the cover being movable between an open position and a closed position;

an elastomeric platen roller rotatable supported by the cover, the thermal print head and the platen roller being relatively resiliently biased toward each other to urge the printing elements carried by the thermal print head into contact with a recording medium disposed between the thermal print head and the platen roller when the cover is in the closed position; and the thermal print head including a platen roller receiving surface positioned to intercept the elastomeric platen roller during movement of the cover to the closed position, the roller receiving surface having a contact area distributing the force exerted by the elastomeric platen roller against the thermal print head during the closing movement of the cover and in which the thermal print head includes:

a transversely extending radiator plate having a reference surface, the reference surface confronting the elastomeric platen roller when the cover is in the closed position, the radiator plate having an upper portion including the platen roller receiving surface; and a substrate mounted on the reference surface of the radiator plate, the printing elements being carried by the substrate, the substrate having an upper extremity adjacent the upper portion of the radiator plate, the substrate further having a thickness, the upper portion of the radiator plate including a projection extending forwardly of the reference surface of the radiator plate a distance at least approximately equal to the thickness of the substrate, the projection including an outer surface merging with the roller receiving surface.

14. A thermal printer, as defined in claim 13, including:

a gap between the projection and the upper extremity of the substrate, the gap permitting adjustment during assembly of the thermal print head of the position of the row of printing elements on the substrate relative to the position of the elastomeric platen roller when the cover is in the closed position.

* * * * *